United States Patent [19]

McCarty et al.

[11] 4,297,855

[45] Nov. 3, 1981

[54] AIR VALVE HEAT PUMP

[75] Inventors: William J. McCarty; Bruce L. Ruark, both of Louisville, Ky.

[73] Assignee: General Electric Company, Louisville, Ky.

[21] Appl. No.: 152,263

[22] Filed: May 21, 1980

[51] Int. Cl.[3] ..... F25B 29/00

[52] U.S. Cl. ..... 62/325

[58] Field of Search ..... 62/140, 160, 325, 429

[56] References Cited

U.S. PATENT DOCUMENTS

| | | | |
|---|---|---|---|
| 2,391,151 | 12/1945 | Gibson | 62/325 |
| 2,401,560 | 6/1946 | Graham et al. | 62/325 |
| 2,466,383 | 4/1949 | Cody | 62/325 |
| 2,729,072 | 1/1956 | Dubvig | 62/325 |
| 2,878,657 | 3/1959 | Atchison | 62/325 |
| 2,899,802 | 8/1959 | McMillan | 62/157 |
| 2,911,797 | 11/1959 | Stocking | 62/176 |
| 2,970,816 | 2/1961 | McCarty | 62/325 |
| 2,975,611 | 3/1961 | Pietsch | 62/325 |
| 3,084,522 | 4/1963 | Hames, Jr. et al. | 62/325 |
| 3,143,864 | 8/1964 | Schordine | 62/325 |
| 3,995,446 | 12/1976 | Eubank | 62/325 |

*Primary Examiner*—Lloyd L. King

*Attorney, Agent, or Firm*—Frank P. Giacalone; Radford M. Reams

[57] ABSTRACT

The present invention relates to a heat pump that utilizes unidirection refrigerant flow wherein the condenser and evaporator retain their functions, but the air directed across them is redirected for different operations. While the heat pump is operating in the cooling mode, air dampers are positioned so that outdoor air is passed in heat exchange relationship with the condenser for liquefying the refrigerant and outside again; and indoor air is passed in heat exchange relationship with the evaporator for cooling the air circulated again. Conversely, in the heating mode, the air dampers are positioned so that outdoor air passed in heat exchange relationship with the evaporator for vaporizing the refrigerant, then outside again; and indoor air is passed in heat exchange relationship with the condenser for heating the air and circulated again.

8 Claims, 7 Drawing Figures

FIG.7
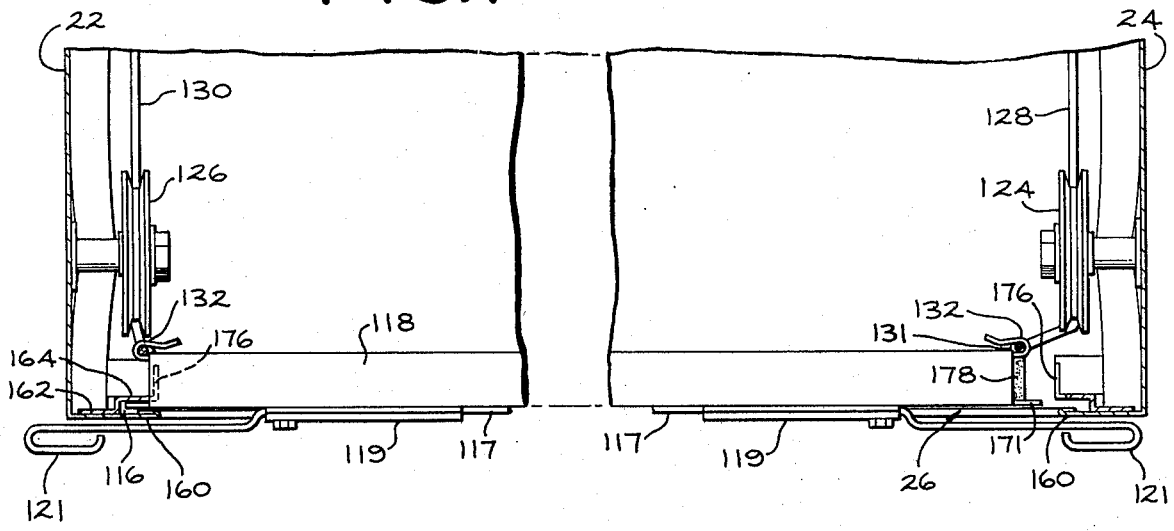
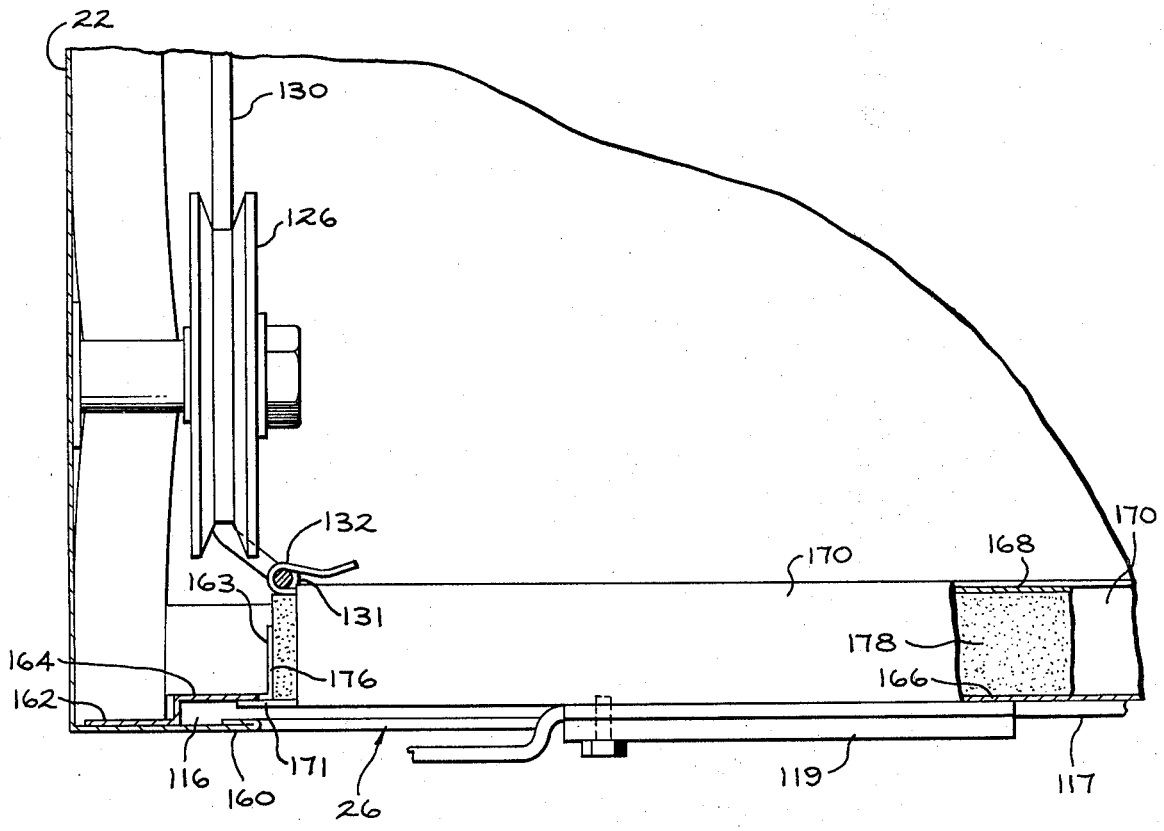
FIG. 4

FIG. 5
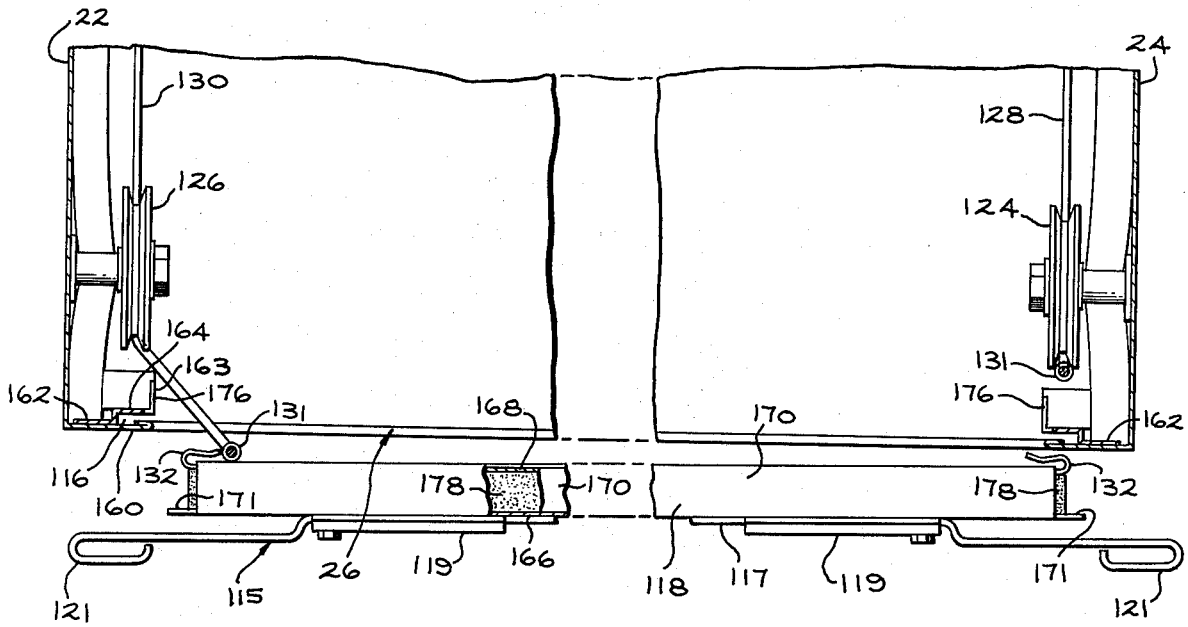
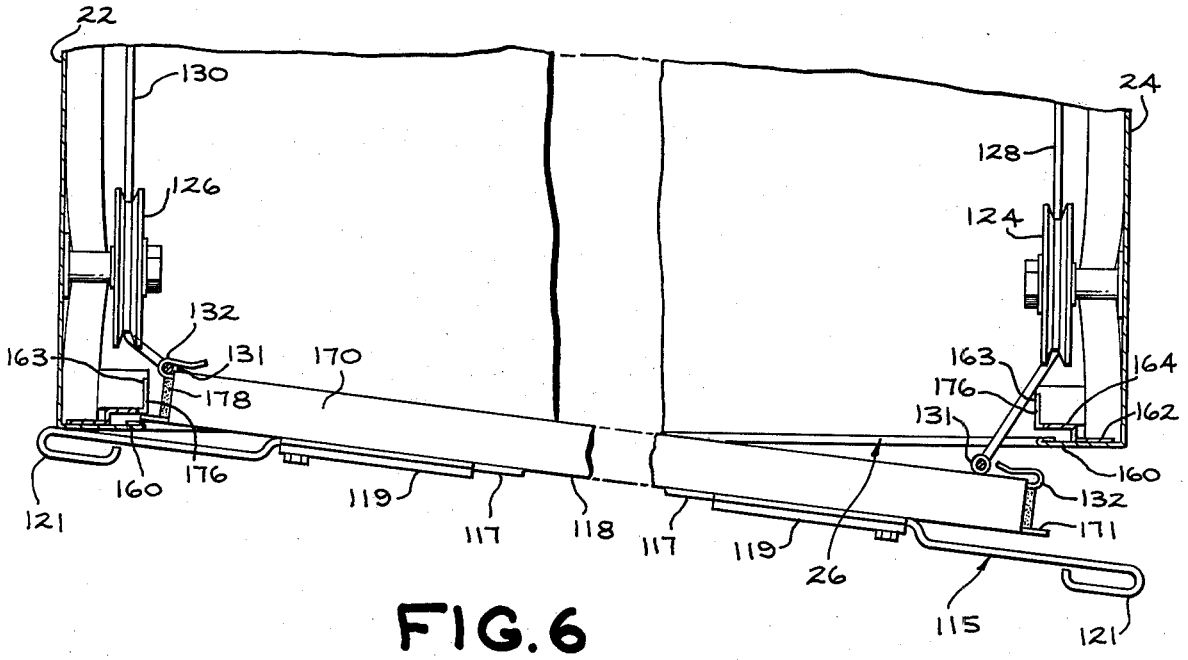
FIG. 6

AIR VALVE HEAT PUMP

BACKGROUND OF THE INVENTION

This invention relates to air conditioners known as heat pumps: and, more particularly, to a reverse air cycle air conditioner that may be used for cooling or heating by redirecting air distribution.

There are two common types of heat pumps, or air conditioners that are used for heating as well as cooling. One type of heat pump reverses the refrigerant flow, thus the functions of the evaporator and condenser interchange. This type has disadvantages; including the use of a relatively expensive reversing valve, and other components necessary to allow the interchange of heat exchangers that may be costly to replace and maintain.

Another type of heat pump utilizes unidirection refrigerant flow wherein the condenser and evaporator retain their functions, but the air directed across them is redirected for different operations. While the heat pump is operating in the cooling mode, outdoor air is passed in heat exchange relationship with the condenser for liquefying the refrigerant and outside again; and indoor air is passed in heat exchange relationship with the evaporator for cooling the air circulated again. Conversely, in the heating mode, outdoor air passes in heat exchange relationship with the evaporator for vaporizing the refrigerant, then outside again; and indoor air is passed in heat exchange relationship with the condenser for heating the air and circulated again.

One prior art patent, U.S. Pat. No. 2,878,657—Atchison, assigned to General Electric Company, the assignee of the present invention, discloses the latter type heat pump wherein the air conditioning unit includes a plurality of air controlling valves each of which is associated with an opposed inlet and outlet opening of the unit that permit selective control of the air flowing into and discharging from the unit in order to direct air either from the outside or from within the enclosure over either of the heat exchangers disposed within separate compartments of the unit.

Another prior art patent, U.S. Pat. No. 3,995,446, discloses a unit having a rotatable damper that can mutually and exclusively place the condenser and evaporator in the desired degree of communication with the outdoor or the indoor.

SUMMARY OF THE INVENTION

The present invention provides an air conditioning apparatus for conditioning air in an enclosure having a wall opening, and more particularly to an air conditioner including a housing adapted to be positioned in the wall opening with one side of said housing facing the outdoors and the opposite side of the housing facing said enclosure. A central chamber is defined by spaced partitions dividing the housing into an evaporator compartment and a condenser compartment. Arranged in the housing is a refrigerating system including a condenser in the condenser compartment, an evaporator in the evaporator compartment and a compressor in the central compartment. Positioned in each of the compartments is a fan shroud that substantially divides the evaporator and condenser compartments into inlet and outlet sections, each of the sections having an opening in both the indoor and outdoor facing side of the housing. A fan is positioned in each of the shrouds for circulating air through the evaporator and condenser compartments in a direction from the inlet section to the outlet section. Movable air valve means are provided for controlling the flow of air through the evaporator and condenser compartments for heating or cooling the enclosure. The air valve means include a first damper slidably arranged in the indoor facing side of the housing that is associated with the indoor facing openings of the compartments and a second damper slidably arranged in the outdoor facing side of the housing that is associated with the outdoor facing opening of the compartments. By the present invention, means for and the method of mounting the dampers in housing is provided. The dampers are interconnected so that they are simultaneously selectively positioned between a first cooling position wherein the indoor facing openings of the evaporator compartment communicate with the enclosure and the outdoor facing openings of the condenser compartment communicate with the outdoors for cooling the air, to a second heating position wherein the indoor facing openings in the condenser compartment communicate with the indoors for heating the air.

DESCRIPTION OF THE DRAWINGS

FIG. 4 is an enlarged fragmentary plan view showing details of the invention.

FIG. 5 is a fragmentary plan view showing the damper partially installed.

FIG. 6 is a plan view similar to FIG. 5 showing another step in the installation of a damper; and FIG. 7 is a view showing still another step in the installation of a damper.

DESCRIPTION OF THE PREFERRED EMBODIMENT

Figure 1:
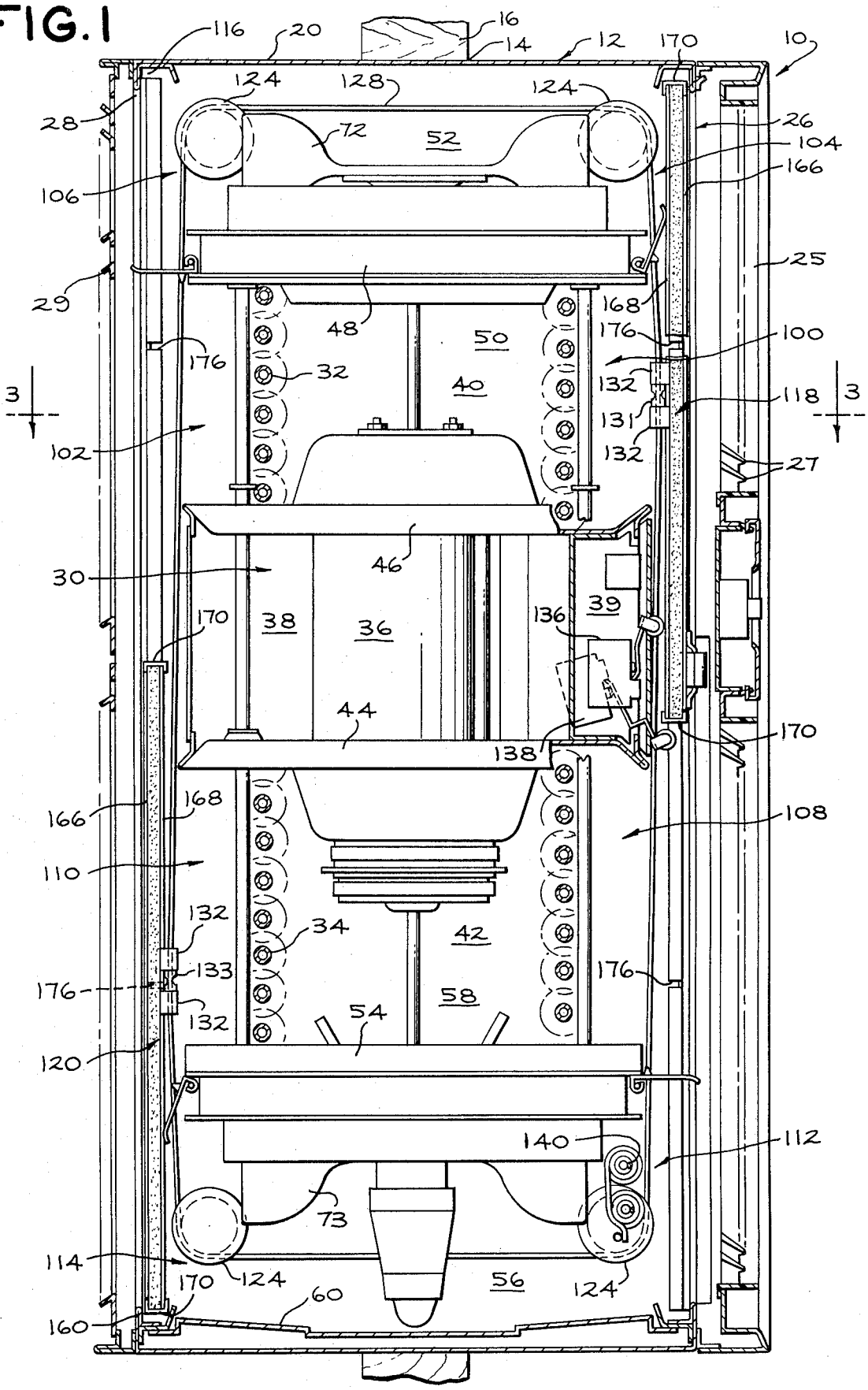
FIG. 1 is a side elevational view in section of the self-contained air conditioning unit incorporating the present invention.

Referring now to the drawings and more particularly to FIG. 1, there is shown an air conditioner unit 10 including a housing 12 that is adapted to be arranged in an opening 14 in the wall 16 of an enclosure to be conditioned. The housing 12 is generally rectangular in shape (FIG. 2) and includes bottom and top walls 18 and 20 respectively interconnected by longer side walls 22 and 24. The housing walls (FIG. 1) define generally a front opening 26 disposed in the enclosure side of wall 16 and a rear opening 28 disposed in the outdoor side of wall 16. Arranged over the front opening 26 of housing 12 is a front grille or appearance member 25 which includes appropriate air deflecting vanes 27, while a grille 29 is positioned over the rear opening 28.

Figure 2:
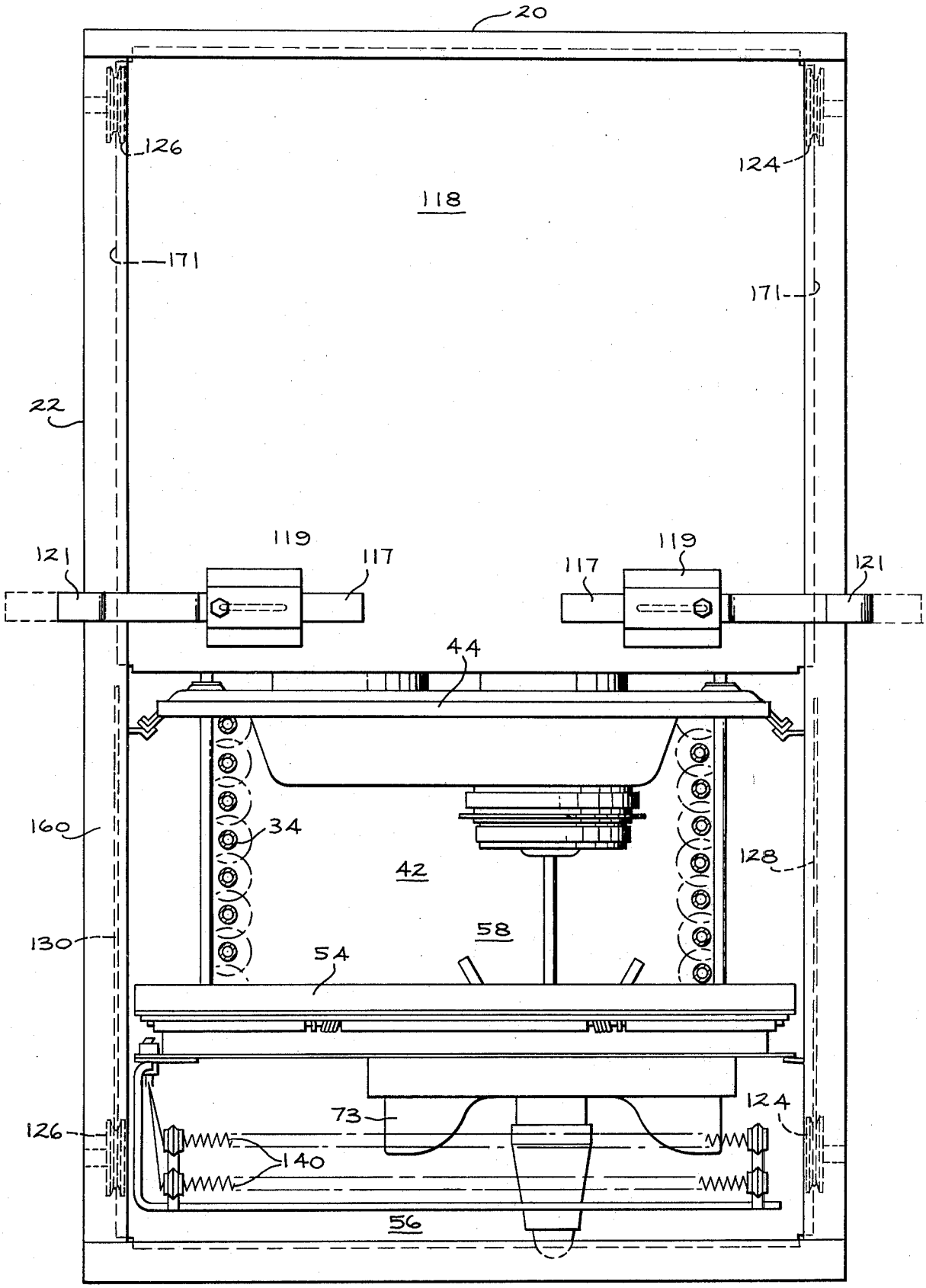
FIG. 2 is a front elevational view partially in section of the self-contained air conditioning unit incorporating the present invention.

Mounted within the housing 12 is a removably arranged chassis 30. Mounted on chassis 30, is the air conditioner refrigeration system including an evaporator 32 and a condenser 34 connected in refrigerant flow relationship with a compressor 36. Referring to FIGS. 1-2, it will be seen that the chassis 30 includes a plurality of parallel spaced partitions that divide the housing 12 to include a central or machine compartment 38, which houses the compressor 36 and a control box 39, an upper or evaporator compartment 40 and a lower or condenser compartment 42. The partitions of chassis 30 include two spaced substantially parallel central partitions 44 and 46 which define the central compartment 38. An upper fan shroud partition member 48 substantially divides the upper evaporator compartment 40 into an inlet area 50 defined by member 48 and partition 46 and an outlet area 52 defined by member 48 and the upper wall 20 of housing 12. A lower fan shroud partition 54 substantially divides the lower condenser compartment 42 into an inlet area 58 defined by the member 54 and partition 44 and an outlet area 56 defined by member 54 and sump pan 60 arranged in the lower wall 18 of housing 12.

Air is circulated by a fan 72 arranged in shroud 48 from the evaporator inlet section 50 to evaporator outlet section 52 and similarly air is circulated by a fan 73 arranged in shroud 54 from the condenser inlet 58 to condenser outlet section 56.

Referring to FIG. 1, it can be seen that the inlet and outlet sections of the evaporator and condenser compartments are arranged within the rectangular housing 12 with each section having a pair of openings therein, one pair communicating with opening 28 facing the outdoors, and a second pair of openings communicating with opening 26 facing the enclosure whereby air can be both introduced and discharged from the evaporator and condenser compartments in two different directions. More specifically, the evaporator compartment inlet section 50 contains openings 100 and 102 and the outlet section 52 contains openings 104 and 106 in the indoor and outdoor side respectively of housing 12. Similarly condenser compartment inlet section 58 is provided with openings 108 and 110, and the outlet section 56 is provided with opening 112 and 114 in the indoor and outdoor side respectively of housing 12. As will now be explained the inlet and outlet openings of each compartment on the indoor and outdoor side of housing 12 is provided with means for selectively controlling the air flow through the condenser and evaporator compartments.

Figure 3:
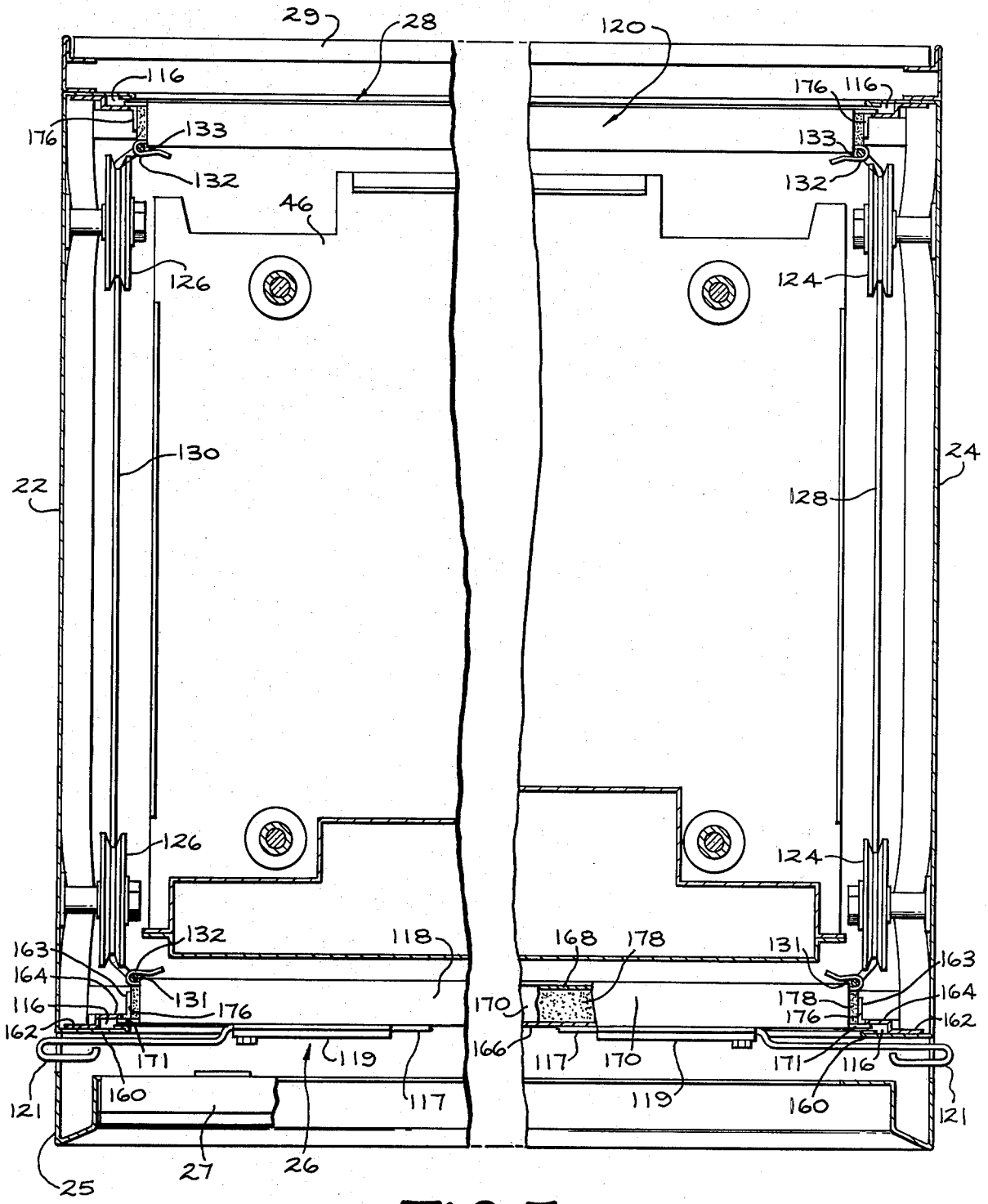
FIG. 3 is an enlarged sectional plan view taken along lines 3—3 of FIG. 1.

As may be seen in FIG. 1 and 3, the openings 26 and 28 of housing 12 are provided with channel or track portions 116 that extend along substantially the entire length of the vertical sides of openings 26 and 28. Each opening 26 and 28 is provided with means for controlling air flow through the evaporator and condenser compartments. In the present embodiment, air flow is controlled by a pair of air valves or dampers 118 and 120 that are fitted for vertical movement in the track portions 116 associated with openings 26 and 28 respectively.

The tracks 116 along each vertical side of openings 26 and 28 are substantially identical and, accordingly, the track associated with the front opening 26 only will be explained with the same reference numbers being applied to similar parts associated with the rear opening 28. The housing 12 is provided with a flange or frame member 160 that extends substantially perpendicular to the side walls of housing 12 (FIGS. 3–7) to, in effect, frame each of the housing openings 26 and 28. Secured to the housing is a bracket 162 that includes a wall portion 164 that is parallel to and spaced from the inner wall surface of flange 160 and wall portion 163 substantially perpendicular to wall 164 and extending inwardly relative to the housing. The track 116 being defined by the frame 160 and portion 164. It should be noted that while in the present embodiment, a separate bracket is employed to provide the track in cooperation with the housing frame, in the alternative the housing can be formed to include a track portion.

The dampers include a front wall 166 and a rear or inner wall 168. The walls 166, 168 being spaced by walls 170 that extend along the upper and lower sides of the dampers. The distal vertical edge of the front wall 166 include guide portions 171 that extend laterally beyond the walls 168 and 170. The horizontal dimension of front wall 166, including the guide portions 171 is larger than the width of the housing openings defined by the frame 160 so that with the dampers installed as shown in FIG. 3, the guide portions 171 along the vertical edges of the damper extend into the tracks 116.

Means are provided by the present invention to allow horizontal movement of the damper so that the guide portions 171 can pass through the narrower opening defined by frame 160 and be positioned in the tracks 116, while at the same time prevent accidental horizontal movement of the dampers once they are positioned in their respective tracks 116 as shown in FIG. 3. The interior of each damper is filled with a flexible insulating material 178 such as a closed cell ethafoam. The insulation as shown in FIG. 3 extends laterally beyond the walls 168 and 170. Each of the portions 164 and more specifically the portions 163 are provided with cut-outs or notches 176 that are spaced vertically and dimensioned to receive the ends of upper and lower walls 170.

In installing a damper in tracks 116, the end or tab portions of walls 70 are first aligned with notches 176 and then one of the vertical disposed guide portions 171 of the damper is positioned in its associated track 116 as shown in FIG. 6. The continued horizontal or lateral movement of the damper compresses the insulating material 178 projecting from the interior of the damper against wall 163 until the end portions of wall 170 enter the notches 176 as shown in FIG. 7. In practice, the insulation will be compressed an amount sufficient to permit the portion of the wall 163 between the notches 176 to be positioned in the interim of the damper between walls 166 and 168. This horizontal movement continues until the opposite vertical guide portion 171 of the damper enters or is within the boundary of the housing opening 26 and in alignment with track 116 as shown in FIG. 7. At this point, the damper is released and the compressed insulation 178 allowed to expand and center the damper so that both vertical guide portions 171 are positioned in the track 116 as shown in FIG. 3. The insulation 178 extending past the walls 168 and 170 is dimensioned so that with the damper in its installed position, the insulation is slightly compressed to insure that a seal is maintained between the wall 163 and the damper. It should be noted that the notches are arranged so that the damper can be installed or removed only when it's in an intermediate or non-operating position. This arrangement insured against accidental removal of a damper during operation of the air conditioner.

In the illustrated embodiment of the invention, the dampers are interconnected to insure proper location of one damper over a compartment inlet and outlet opening one one side of the housing by movement of the other damper arranged on the other side of the housing. To this end (FIGS. 1 and 2), there is provided a first set of four rollers 124 rotatably mounted on the side wall 24 of housing 12 and a similar set of four rollers 126 rotatably mounted on the side wall 22 of housing 12. With reference to FIG. 1, it will be seen that the rollers are mounted near the corner portions of the side walls to, in effect, outline a rectangle on each side wall. Arranged on rollers 124 is an endless cable 128, while an endless cable 130 is arranged on the rollers 126. As shown in FIG. 3, the front damper 118 is secured to each vertical pass of the cables 128, 130 at a point where they communicate with the front opening 26, while the back damper 120 is secured to the cables 128, 130 at a point where they communicate with the rear opening 28.

Means are provided to insure that the outdoor damper 120 is properly positioned relative to the outdoor openings of compartments 40 and 42 at the time that the user positioned the indoor damper relative to the indoor openings of compartments 40 and 42. To this end, indexing members 131 are arranged on the vertical passes of cables 128 and 130 in front opening 26 while indexing members 133 are arranged on the vertical passes of cables 128 and 130 in the rear opening 28 diametric or 180° relative to member 131. Provided adjacent the vertical edge of the inner walls 168 of the dampers are spaced fastening portions 132. The portions 132 are spaced to receive the indexing member 131, 133 as shown in FIG. 1. The portions 132 may be dimensioned to snap over the cable to secure the dampers against movement relative to the cables as shown in FIGS. 3–7 or alternatively, the portions 132 may be crimped to mechanically lock them to the cable. The connection between the indexing members 131 and 133 and portions 132 of their respective dampers 118 and 120 are completed at the time the dampers are installed in track 116. For example, with the damper in the position shown in FIG. 5, the damper portion 132 adjacent the vertical pass of the cable 130 is positioned and secured relative to the indexing member 131 on cable 130. Portion 132 on the opposite side of the damper as shown in FIG. 6 is secured to the indexing member 131 on cable 128 prior to completing the installation of the damper. Accordingly, vertical movement of the front damper 118 positioned in the enclosure side of housing 12 by the user of the air conditioner will cause an opposite vertical movement of the back damper 120 when positioned on the indexing members 133 in the outdoor side of the housing 12.

In summary, the steps in assembling each damper relative to the housing include placing the damper in an initial non-operative position wherein the end portions of the upper and lower walls 170 on one side of the damper are arranged in alignment with the notches 176 of track 116. The cables 128 and 130 are then secured to the damper by placing the indexing members 131 between the portions 132 as described above. With the damper so secured to the cables, the guide portion 171 along one vertical edge of the damper is positioned in track 116 as shown in FIG. 6. The damper, with the end portions of walls 170 aligned with notches 176 is moved in a horizontal direction to the left in FIG. 7 so that the insulating member 178 compresses and the end portions of walls 170 enter the slots 176 until the opposite guide portion 171 clears the inner edge of frame 160 as shown in FIG. 7. At this time, the damper is pivoted about the guide 171 that is positioned in track so that the opposite guide 171 is in alignment with its track 116 as shown in FIG. 7. The damper is now in a position to be moved to the right and centered so that both of the guides 171 are located in their respective tracks 116. Centering of the damper is aided by action of the insulating as it returns to its normal or extended position. The dimension of the insulating members are such that they are both under slight compression when the damper in is located in the track.

In use, with the dampers 118, 120 arranged in the heating position shown in FIG. 1, the air flow through the conditioner 10 is such as to heat the air circulated from the enclosure. That is in the heating mode with the damper 118 closing the enclosure side inlet openings 100 and outlet opening 104 of evaporator compartment 40, air from the enclosure is drawn into the condenser compartment 42 through inlet 108 where it is passed through the condenser 34 heated and then back into the enclosure through outlet 112. In the heating mode, damper 120 closes the outside inlet openings 110 and outlet opening 114 of the condenser compartment 42 and air from the outdoors is drawn into the evaporator compartment through inlet 102 where it is passed through the evaporator 32 and back into the outdoors through outlet 106.

In the cooling mode the indoor damper 118 would be positioned by the user of the air conditioner over the enclosure side condenser inlet 108 and outlet 112 section openings so that enclosure air is drawn into the evaporator compartment through uncovered inlet 100 where it is passed through the evaporator and cooled and then back into the enclosure through outlet 104. In this mode the outdoor damper 120 would be positioned over the outdoor evaporator inlet 102 and outlet 106 openings so that outdoor air is drawn into the uncovered condenser compartment 42 through inlet 110 where it is passed through the condenser and then back into the outdoors through outlet 114. To facilitate movement of the indoor damper 118 by the user there is provided a pair of handles 115 as shown in FIGS. 1 and 5. The handles 115 include a portion 117 slidably arranged in a sleeve 119 which is secured to the front surface of damper 118 and a handle portion 121. The handle portion 121 extends between the front wall of housing 12 and grille 25 for easy access by the user. For ease in gripping, the handles 115 may be extended to the broken line position shown in FIG. 2.

Control means are provided that prevent operation of the unit in the event the damper doors or air valves are not positioned properly relative to the selected inlet and outlet openings. To this end, there is mounted in the control box 39 a pair of switches 136 and 138. The switch 136 is a heater control switch through which a resistance heater 140 is energized. The switch 136 is moved to its closed position when the damper 118 is in its up position and enclosure air is accordingly circulating through the condenser compartment 42. The switch 136 also orients the thermostat 142 so that it functions during the heating cycle between a lower ambient and a higher set temperature. The switch 136 is effective in locking out the heater 140 when the damper is in its down or cooling position and enclosure air is accordingly circulating through the evaporator compartment 40. The switch 138 orients the thermostat 142 so that it functions during the cooling cycle between a higher ambient and lower set temperature when the damper is in the down position. Another feature of the switch arrangement is to prevent operation of the air conditioner if both switches are closed. In effect, the switches are so arranged that the damper 118 must be either in its fully up heating position which means damper 120 is in its fully lowered position or in its down position, or cooling position which means damper 120 is in its fully up position.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. An air conditioning apparatus for conditioning air in an enclosure having a wall opening comprising:

a housing having openings on opposite sides thereof adapted to be positioned in said wall opening with the opening on one side of said housing facing the outdoors and the opening on the other side of said housing facing said enclosure;

a central chamber defined by spaced partition means dividing said housing into an evaporator compartment and a condenser compartment;

a refrigerating system including a condenser in said condenser compartment, an evaporator in said evaporator compartment and a compressor in said central chamber;

a fan shroud partition means in each of said compartments substantially dividing said compartments into inlet and outlet sections, each of said sections having an opening in both the indoor and outdoor facing side of said housing; a fan within each of said shrouds for circulating air through each of said compartments in a direction from said inlet section to said outlet section;

a first damper slidably arranged in the indoor facing side of said housing being associated with the indoor facing openings of said compartments; said damper is dimensioned to cover the inlet and outlet section openings of one of said compartments, a second damper slidably arranged in the outdoor facing side of said housing being associated with the outdoor facing opening of said compartments, said damper dimensioned to cover the inlet and outlet section openings of the other of said compartments;

means interconnecting said dampers for selectively positioning said dampers to a first cooling position including;

a plurality of support members positioned in said housing;

a flexible member having a continuous length being arranged on said support members so that a substantially straight portion is arranged adjacent said front and rear facing openings of said housing;

indexing means on said straight portions of said flexible members arranged diametric relative to front and rear facing openings;

retaining means on said front and rear dampers being dimensioned to engage said indexing means for interconnecting said dampers on said flexible member wherein when the first damper is arranged so that the indoor facing inlet and outlet section openings of said evaporator compartment communicate with the enclosure, the second damper is arranged so that the outdoor facing inlet and outlet section openings of said condenser compartment communicate with said outdoors for cooling the air in said enclosure and to a second heating position wherein when the first damper is arranged so that the indoor facing inlet and outlet section openings of said condenser compartment communicate with the enclosure, the second damper is arranged so that the outdoor facing inlet and outlet section openings of said evaporator compartment communicate with said outdoors for removing heat from the outdoor air by cooling the air.

2. The air conditioning apparatus according to claim 1 wherein said damper interconnecting means further include;

a set of support members positioned on each side wall in said housing;

a flexible member having a continuous length being arranged on each set of support members, so that a substantially straight parallel portion of each flexible member is arranged adjacent the vertical edge portion of said front and rear facing openings of said housing;

indexing means on each of the parallel portions of each flexible member with the indexing mean adjacent the rear facing opening of said housing being arranged diametric to the indexing means adjacent the front facing opening of said housing;

cable retaining means on said front and rear dampers being dimensioned to engage said indexing means for interconnecting said dampers on said flexible member so that movement of one of said dampers arranged in one of said housing openings over the inlet and outlet section openings of one of said compartment openings causes movement of said damper in the other of said housing openings to a position over the inlet and outlet openings of the other of said compartment openings.

3. The air conditioning apparatus according to claim 1 further including a frame member arranged around said indoor and outdoor facing housing openings;

a wall portion spaced from and substantially parallel to the vertical portion of said frame member to form a pair of substantially parallel track means therebetween along the vertical sides of said housing openings;

guide means extending outwardly from the vertical edge of portion of said damper, having a horizontal dimension between the distal ends of said guide means sufficient to position said guide means in said pair of track means;

tab portions on the vertical edge portion of said damper being spaced to engage said notch means to permit horizontal movement of said damper a distance sufficient to allow insertion of said damper guide means in said track.

4. The air conditioning apparatus according to claim 3 further including spaced notch means associated with said track being engageable by said damper when it is intermediate its cooling and heating position.

5. An air conditioning apparatus for conditioning air in an enclosure having a wall opening comprising;

a housing, including side walls interconnected by a bottom and top wall, adapted for mounting in said wall opening with one open side of said housing facing the enclosure and the other open side of said housing facing the outdoors;

a first partition, including an aperture, disposed within the housing and extending substantially between said side walls defining an outlet area between said partition and the bottom wall of said housing;

a second partition disposed within the housing and extending substantially between said side walls being separate and substantially parallel to the first partition defining an inlet area, including an aperture in axial alignment with the aperture in the first partition;

a fan arranged on the first partition aperture for moving air into said inlet area and through said outlet area;

a condenser housed in said outlet area between first and second partition;

a third partition disposed within the housing and extending substantially between said side walls separate and substantially parallel to the first and second partition forming a central compartment between said second and third partitions, including an aperture in axial alignment with the apertures in the first and second partitions;

a compressor housed in said central compartment;

a fourth partition disposed within the housing and extending substantially between said side walls separate and substantially parallel to the third partitions forming a second inlet area between said third and fourth partitions defining a second outlet area between said partition and the top wall of said housing, including an aperture in axial alignment with the other apertures;

an evaporator housed in said second inlet area between the third and fourth partitions;

a fan arranged in fourth partition aperture for moving air into said second inlet area and through said second outlet area; and driving means in said central compartment arranged in the apertures of said second and third partitions, including axial shaft means for driving said fans in said first and fourth partition apertures respectively;

a first damper arranged in one opening of said housing moveable between a first position over said first inlet and said first outlet for allowing circulation of enclosure air between said second inlet area and said second outlet for cooling said enclosure air to a second position over said second inlet area and said second outlet area for allowing circulation of enclosure air between said first and second compartments for heating said enclosure;

a second damper arranged in the other opening of said housing being moveable to circulate air through said evaporator to said outdoors when said indoor air is being heated and positioned to circulate air through said condenser to said outdoors when said indoor air is being cooled;

a plurality of support members positioned in said housing;

a flexible member having a continuous length being arranged on said support members so that a substantially straight portion is arranged adjacent said front and rear facing openings of said housing;

indexing means on said straight portions of said flexible members arranged diametric relative to front and rear facing openings;

retaining means on said front and rear dampers being dimensioned to engage said indexing means for interconnecting said dampers on said flexible member so that movement of one of said dampers arranged in one of said housing openings to a position over the inlet and outlet section openings of one of said compartment openings causes movement of said damper on the other of said housing opening to a position over the inlet and outlet section openings of the other of said compartment openings.

6. The air conditioning apparatus according to claim 5 wherein said damper interconnecting means further include;

a set of support members positioned on each side wall in said housing;

a flexible member having a continuous length being arranged on each set of support members, so that a substantially straight parallel portion of each flexible member is arranged adjacent the vertical edge portion of said front and rear facing openings of said housing;

indexing means on each of the parallel portions of each flexible member with the indexing mean adjacent the rear facing opening of said housing being arranged diametric to the indexing means adjacent the front facing opening of said housing;

cable retaining means on said front and rear dampers being dimensioned to engage said indexing means for interconnecting said dampers on said flexible member so that movement of one of said dampers arranged in one of said housing openings over the inlet and outlet section openings of one of said compartment openings causes movement of said damper in the other of said housing openings to a position over the inlet and outlet openings of the other of said compartment openings.

7. The air conditioning apparatus according to claim 5 or 6 further including a frame member arranged around said indoor and outdoor facing housing openings;

a wall portion spaced from and substantially parallel to the vertical portion of said frame member to form a pair of substantially parallel track means therebetween along the vertical sides of said housing openings;

guide means extending outwardly from the vertical edge of portion of said damper, having a horizontal dimension between the distal ends of said guide means sufficient to position said guide means in said pair of track means;

tab portions on the upper and lower edge portion of said damper being spaced to engage said notch means to permit horizontal movement of said damper a distance sufficient to allow insertion of said damper guide means in said track.

8. The air conditioning apparatus according to claim 5 or 6 further including spaced notch means associated with said track being engageable by said damper when it is intermediate its cooling and heating position.

* * * * *